US007397446B2

(12) United States Patent
Chen et al.

(10) Patent No.: US 7,397,446 B2
(45) Date of Patent: Jul. 8, 2008

(54) PLASMA DISPLAY PANEL DRIVING CIRCUIT

(75) Inventors: Bi-Hsien Chen, Ping-Tung Hsien (TW); Yi-Min Huang, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 189 days.

(21) Appl. No.: 11/425,704

(22) Filed: Jun. 21, 2006

(65) Prior Publication Data

US 2006/0290606 A1 Dec. 28, 2006

Related U.S. Application Data

(60) Provisional application No. 60/595,303, filed on Jun. 22, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66; 315/169.3, 169.4; 313/567

See application file for complete search history.

(56) References Cited

U.S. PATENT DOCUMENTS

| | | | | |
|---|---|---|---|---|
| 5,828,353 | A | 10/1998 | Kishi et al. | |
| 6,628,275 | B2 * | 9/2003 | Vossen et al. | 345/211 |
| 6,680,581 | B2 * | 1/2004 | Lee et al. | 315/169.3 |
| 6,768,270 | B2 * | 7/2004 | Chae | 315/169.3 |
| 6,781,322 | B2 * | 8/2004 | Onozawa et al. | 315/169.3 |
| 6,933,679 | B2 * | 8/2005 | Lee et al. | 315/169.4 |
| 6,961,031 | B2 * | 11/2005 | Lee et al. | 345/60 |
| 7,023,139 | B2 * | 4/2006 | Lee et al. | 315/169.1 |
| 7,027,010 | B2 * | 4/2006 | Lee | 345/60 |
| 7,123,219 | B2 * | 10/2006 | Lee | 345/76 |
| 7,176,854 | B2 * | 2/2007 | Lee et al. | 345/60 |
| 2003/0173905 | A1 * | 9/2003 | Lee et al. | 315/169.3 |
| 2003/0193454 | A1 * | 10/2003 | Lee et al. | 345/63 |
| 2004/0012546 | A1 * | 1/2004 | Takagi et al. | 345/60 |
| 2004/0135746 | A1 * | 7/2004 | Lee et al. | 345/60 |
| 2006/0238447 | A1 * | 10/2006 | Chen | 345/60 |
| 2006/0267874 | A1 * | 11/2006 | Chen et al. | 345/68 |

FOREIGN PATENT DOCUMENTS

| | | |
|---|---|---|
| EP | 1 498 868 A2 | 1/2005 |

* cited by examiner

*Primary Examiner*—Ricardo Osorio
(74) *Attorney, Agent, or Firm*—Winston Hsu

(57) ABSTRACT

A driving circuit for producing sustain waveforms of a plasma display panel (PDP) is mentioned. The driving circuit includes the functions of voltage clamping and energy recovery. By controlling switches contained in the driving circuit, the supplied voltage source can be made to be only half of the sustain voltage. The voltage stress of some components will therefore be lower. In addition, the numbers of components can be reduced in the driving circuit.

18 Claims, 9 Drawing Sheets

PLASMA DISPLAY PANEL DRIVING CIRCUIT

CROSS REFERENCE TO RELATED APPLICATIONS

This application claims the benefit of the filing date of U.S. provisional patent application No. 60/595,303, filed Jun. 22, 2005, the contents of which are hereby incorporated by reference.

BACKGROUND OF THE INVENTION

1. Field of the Invention

The present invention relates to a driving circuit, and more specifically, to a driving circuit for a plasma display panel (PDP).

2. Description of the Prior Art

In recent years, there has been an increasing demand for planar matrix displays such as plasma display panels (PDP), liquid-crystal displays (LCD) and electroluminescent displays (EL display) in place of cathode ray tube terminals (CRT) due to the advantage of the thin appearance of the planar matrix displays.

In a PDP display, a sustaining discharge pulse activates inert gas to generate ultraviolet so that the ultraviolet further activates fluorescent materials and visible light is emitted to display. As far as the PDP display is concerned, it is required to apply a high voltage to the electrodes. In particular, a pulse-duration of several microseconds is usually adopted. Hence the power consumption of the PDP display is quite considerable. Energy recovering (power saving) is therefore sought for. Many designs and patents have been developed for providing methods and apparatuses of energy recovering for PDPs. One of the examples is U.S. Pat. No. 5,828,353, "Drive Unit for Planar Display" by Kishi, et al., which is included herein by reference.

Please refer to FIG. 1. FIG. 1 is a block diagram of a prior art driving circuit 100. The plasma panel display can be taken as a panel equivalent capacitor Cp. The conventional driving circuit 100 includes four switches S1 to S4 for passing current, an X-side energy recovery circuit 110 and a Y-side energy recovery circuit 120 for charging/discharging the panel equivalent capacitor Cp from the X side of the panel equivalent capacitor Cp and the Y side of the panel equivalent capacitor Cp respectively. S5, S6, S7 and S8 are switches for passing current. D5, D6, D7 and D8 are diodes. V1 and V2 are two voltage sources. C1 and C2 are capacitors adopted for recovering energy, and L1 and L2 are resonant inductors. The X-side energy recovery circuit 110 includes an energy-forward channel comprising the switch S6, the diode D6 and the inductor L1, and an energy-backward channel comprising the inductor L1, the diode D5 and the switch S5. Similarly, the Y-side energy recovery circuit 120 also includes an energy-forward channel comprising the switch S8, the diode D8 and the inductor L2, and an energy-backward channel comprising the inductor L2, the diode D7 and the switch S7.

Please refer to FIG. 2. FIG. 2 is a flowchart of generating the sustaining pulses of the panel equivalent capacitor Cp of the PDP by the conventional driving circuit 100 illustrated in FIG. 1.

Step 200: Start;

Step 210: Keep the voltage potentials at the X side and the Y side of the panel equivalent capacitor Cp at ground by turning on the switches S3 and S4;

Step 220: Charge the X side of the panel equivalent capacitor Cp by the capacitor C1 and keep the voltage potential at the Y side of the panel equivalent capacitor Cp at ground by turning on the switches S6 and S4; wherein the voltage potential at the X side of the panel equivalent capacitor Cp goes up to V1 accordingly;

Step 230: Supply charge to the panel equivalent capacitor Cp of the PDP from the X side by turning on the switches S1 and S4; wherein the voltage potential at the X side of the panel equivalent capacitor Cp keeps at V1 and the voltage potential at the Y side of the panel equivalent capacitor Cp keeps at ground accordingly;

Step 240: Discharge the panel equivalent capacitor Cp from the X side and keep the voltage potential at the Y side of the panel equivalent capacitor Cp at ground by turning on the switches S5 and S4; wherein the voltage potential at the X side of the panel equivalent capacitor Cp goes down to ground accordingly;

Step 250: Keep the voltage potentials at the X side and the Y side of the panel equivalent capacitor Cp at ground by turning on the switches S3 and S4;

Step 260: Charge the Y side of the panel equivalent capacitor Cp by the capacitor C2 and keep the voltage potential at the X side of the panel equivalent capacitor Cp at ground by turning on the switches S8 and S3; wherein the voltage potential at the Y side of the panel equivalent capacitor Cp goes up to V2 accordingly;

Step 270: Supply charge to the panel equivalent capacitor Cp of the PDP from the Y side by turning on the switches S2 and S3; wherein the voltage potential at the Y side of the panel equivalent capacitor Cp keeps at V2 and the voltage potential at the X side of the panel equivalent capacitor Cp keeps at ground accordingly;

Step 280: Discharge the panel equivalent capacitor Cp from the Y side and keep the voltage potential at the X side of the panel equivalent capacitor Cp at ground by turning on the switches S7 and S3; wherein the voltage potential at the Y side of the panel equivalent capacitor Cp goes down to ground accordingly;

Step 290: Keep the voltage potentials at the X side and the Y side of the panel equivalent capacitor Cp at ground by turning on the switches S3 and S4;

Step 295: End.

Please refer to FIG. 3. FIG. 3 shows a diagram illustrating the voltage potentials at the X side and the Y side of the panel equivalent capacitor Cp, and the control signals, M1 to M8, of the switches S1 to S8 in FIG. 1 respectively. In FIG. 3, the horizontal axis represents the time, while the vertical axis represents the voltage potential. Note that the switches S1 to S8 are designed to close (turned on) for passing current when the control signal is high, and to open (turned off) such that no current can pass when the control signal is low.

Conventionally, the energy recovery (power saving) circuit provides two individual channels of charging and discharging the equivalent capacitor respectively (energy-forward channel and energy-backward channel) for each side of the panel equivalent capacitor Cp. Therefore, the amount of required components is quite large. Furthermore, the area of capacitors C1 and C2 is usually considerable. Hence the cost of energy recovery circuit is not easy to reduce.

SUMMARY OF THE INVENTION

It is therefore an objective of the invention to provide plasma display panel driving circuits that solve the problems of the prior art.

According to a preferred embodiment of the present invention, a claimed plasma display panel driving circuit includes a panel equivalent capacitor having a first side and a second side; a first switch electrically connected between the first side of the panel equivalent capacitor and a first voltage; a second switch electrically connected between the first side of the panel equivalent capacitor and a first node; a third switch electrically connected between the first node and a second voltage; a first capacitor electrically connected between the first node and a second node; a fourth switch electrically connected between the second node and the second voltage; a first inductor and a fifth switch electrically connected in series between the second node and a third voltage; a sixth switch electrically connected between the second side of the panel equivalent capacitor and a fourth voltage; a seventh switch electrically connected between the second side of the panel equivalent capacitor and a third node; an eighth switch electrically connected between the third node and a fifth voltage; a second capacitor electrically connected between the third node and a fourth node; a ninth switch electrically connected between the fourth node and the fifth voltage; and a second inductor and a tenth switch electrically connected in series between the fourth node and a sixth voltage.

According to another preferred embodiment of the present invention, a claimed plasma display panel driving circuit includes a panel equivalent capacitor having a first side and a second side; a first switch electrically connected between the first side of the panel equivalent capacitor and a first voltage; a second switch electrically connected between the second side of the panel equivalent capacitor and a second voltage; a third switch electrically connected between the second side of the panel equivalent capacitor and a first node; a fourth switch electrically connected between the first side of the panel equivalent capacitor and the first node; a fifth switch electrically connected between the first node and a third voltage; a sixth switch electrically connected between the third voltage and a second node; a capacitor electrically connected between the first node and the second node; and an inductor and a seventh switch electrically connected in series between the second node and a fourth voltage.

It is an advantage that the voltage potential output by the voltage sources is only half of the sustaining voltage produced by the driving circuit. The voltage stress of some components in the driving circuit will therefore be lower. In addition, the numbers of components can be reduced in the driving circuit.

These and other objectives of the present invention will no doubt become obvious to those of ordinary skill in the art after reading the following detailed description of the preferred embodiment that is illustrated in the various figures and drawings.

DETAILED DESCRIPTION

The present invention provides plasma display panel driving circuits that allow the supplied voltage to be just half of the produced sustaining voltage. The advantages of this invention are that the supplied voltage will be around half of that of the prior art. The voltage stress of some components will therefore be lower. In addition, the numbers of components can be reduced in the driving circuits.

Figure 1:
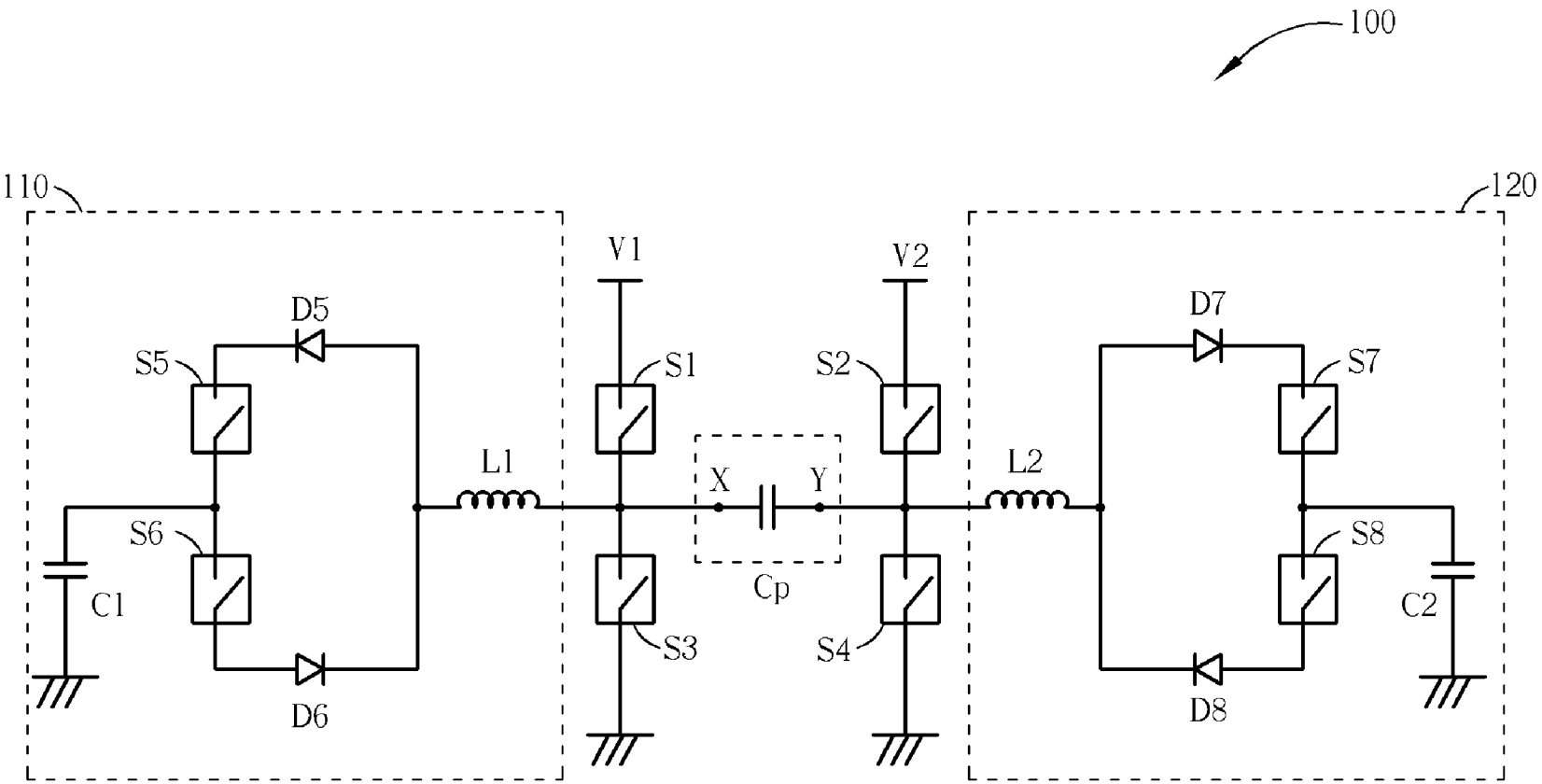
Fig. 1 Prior art
FIG. 1 is a plasma panel display driving circuit diagram of a prior art.
Figure 2:
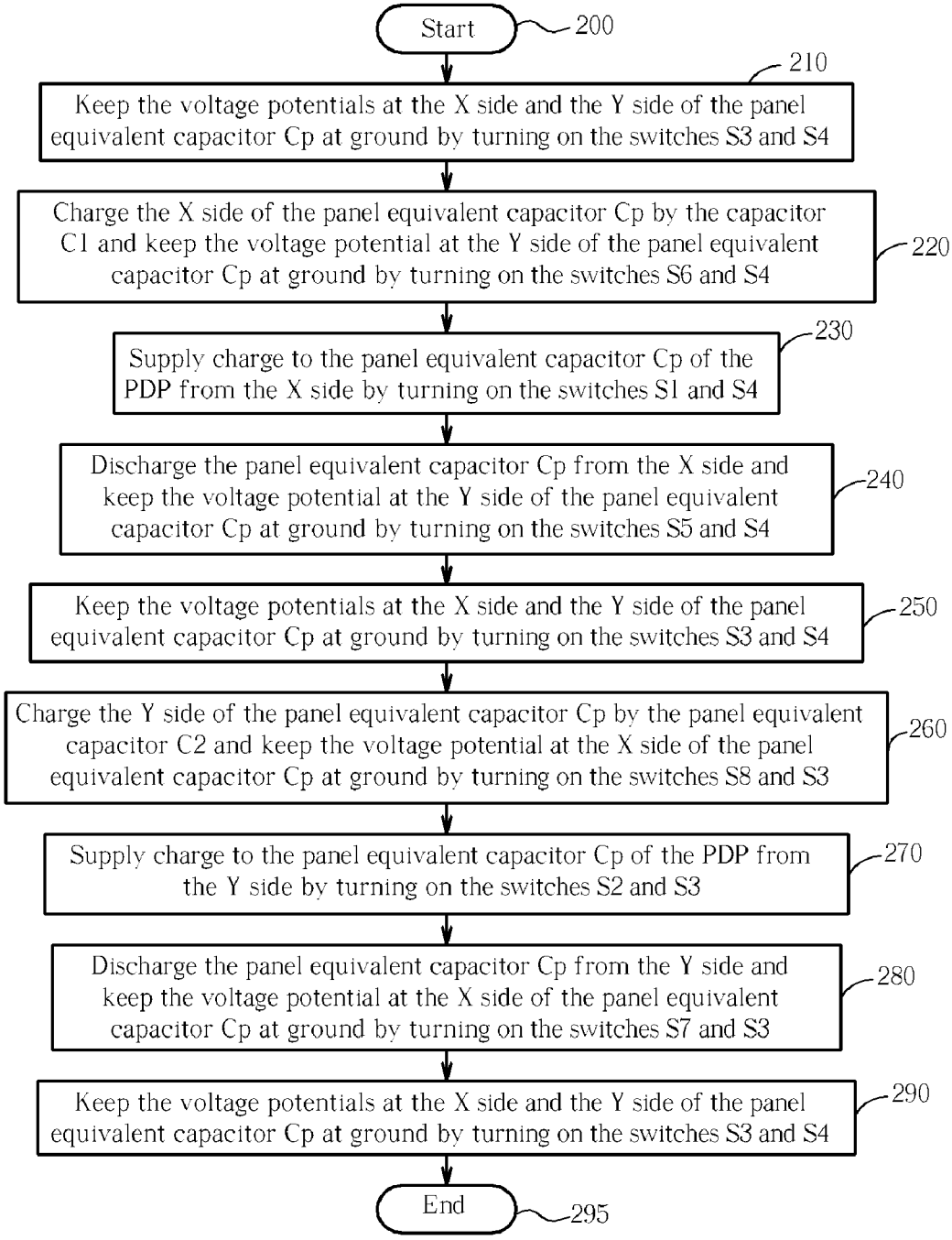
Fig. 2 Prior art
FIG. 2 is a flowchart of a prior art method of generating the sustaining pulses of the panel equivalent capacitor Cp.
Figure 3:
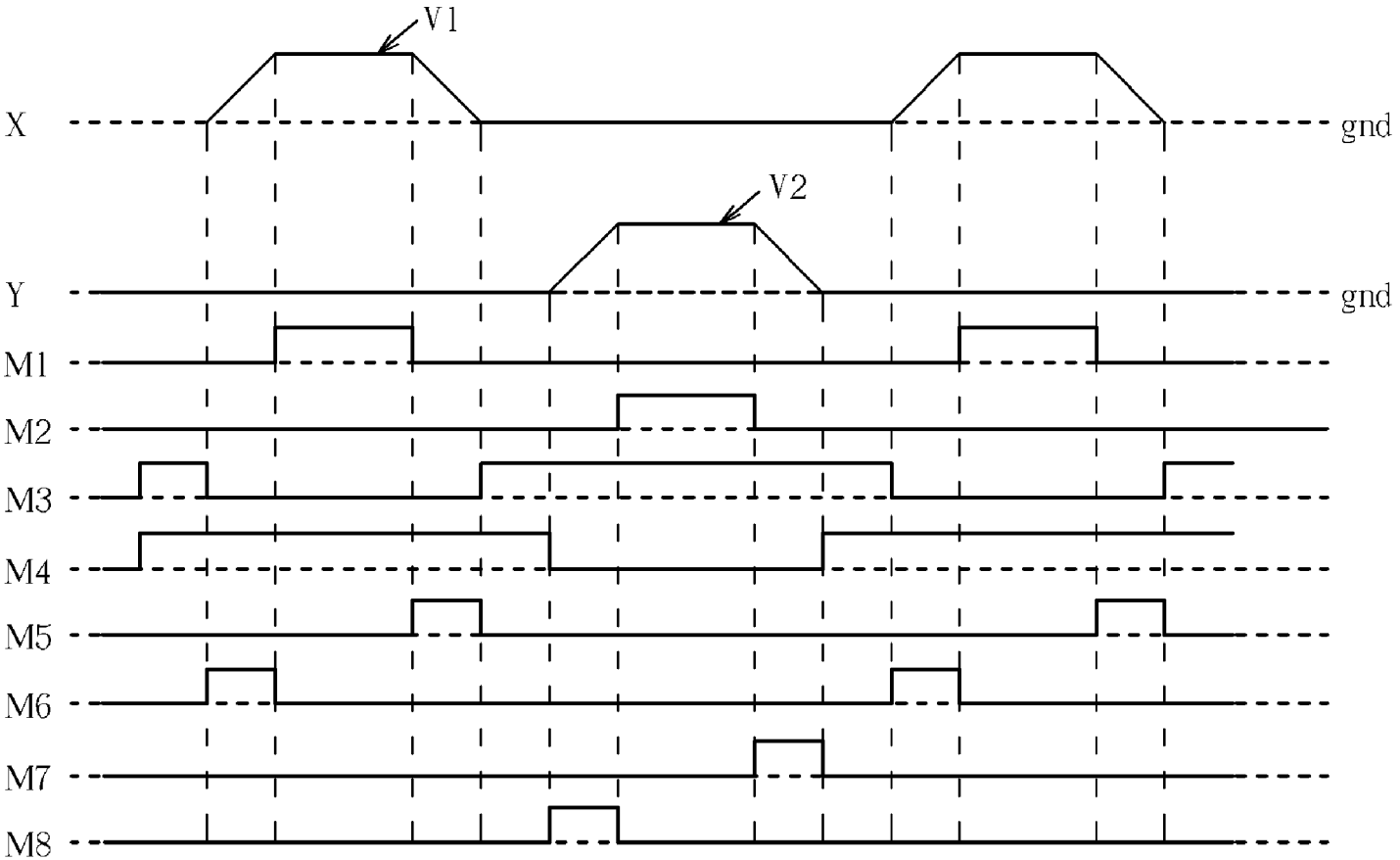
Fig. 3 Prior art
FIG. 3 is a diagram illustrating the voltage potentials at sides of the panel equivalent capacitor Cp and the control signals of the switches.
Figure 4:
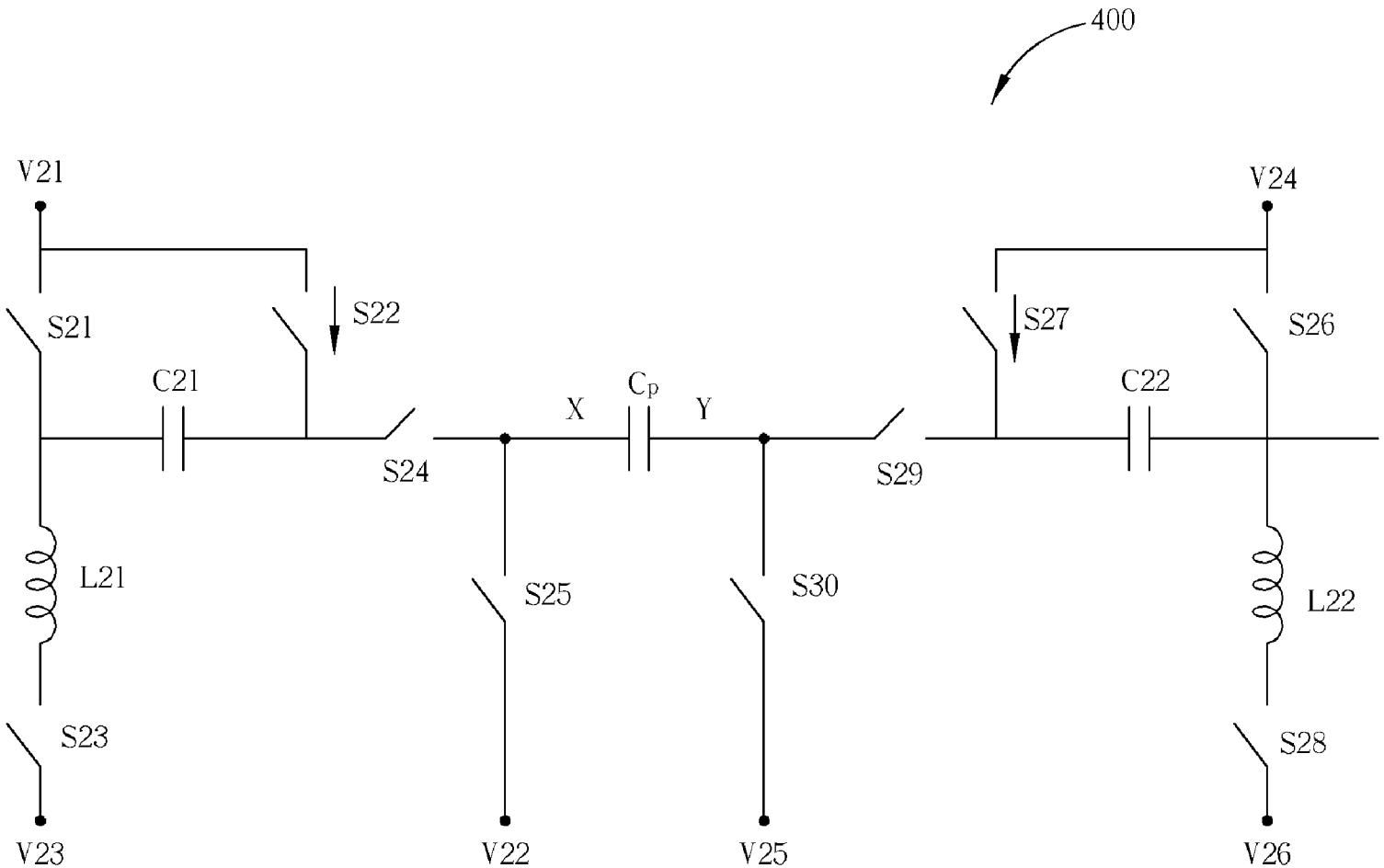
FIG. 4 shows a circuit diagram of a plasma display panel driving circuit according to a first embodiment of the present invention.

Please refer to FIG. 4. FIG. 4 shows a circuit diagram of a plasma display panel driving circuit 400 according to a first embodiment of the present invention. The driving circuit 400 comprises switches S21 to S30, capacitors C21 and C22, inductors L21 and L22, and voltage sources V21 to V26. Switches S22 and S27 are unidirectional switches, and the direction of the current is indicated by the arrows on FIG. 4. The current direction of switch S22 is away from the voltage source V21, and the current direction of switch S27 is away from the voltage source V24. The driving circuit 400 is shown having an panel equivalent capacitor Cp of the PDP, and has an X side and a Y side. The voltage potential output by voltage source V21 is greater than that of the voltage sources V22 and V23. Likewise, the voltage potential output by the voltage source V24 is greater than that of the voltage sources V25 and V26. The voltage potentials output by the voltage sources V21 and V24 can be the same or can be different. Similarly, the voltage potentials output by the voltage sources V22 and V23 and the voltage sources V25 and V26 can be the same or can be different. Inductor L21 and switch S23 are electrically connected in series, as are inductor L22 and switch S28.

Figure 5:
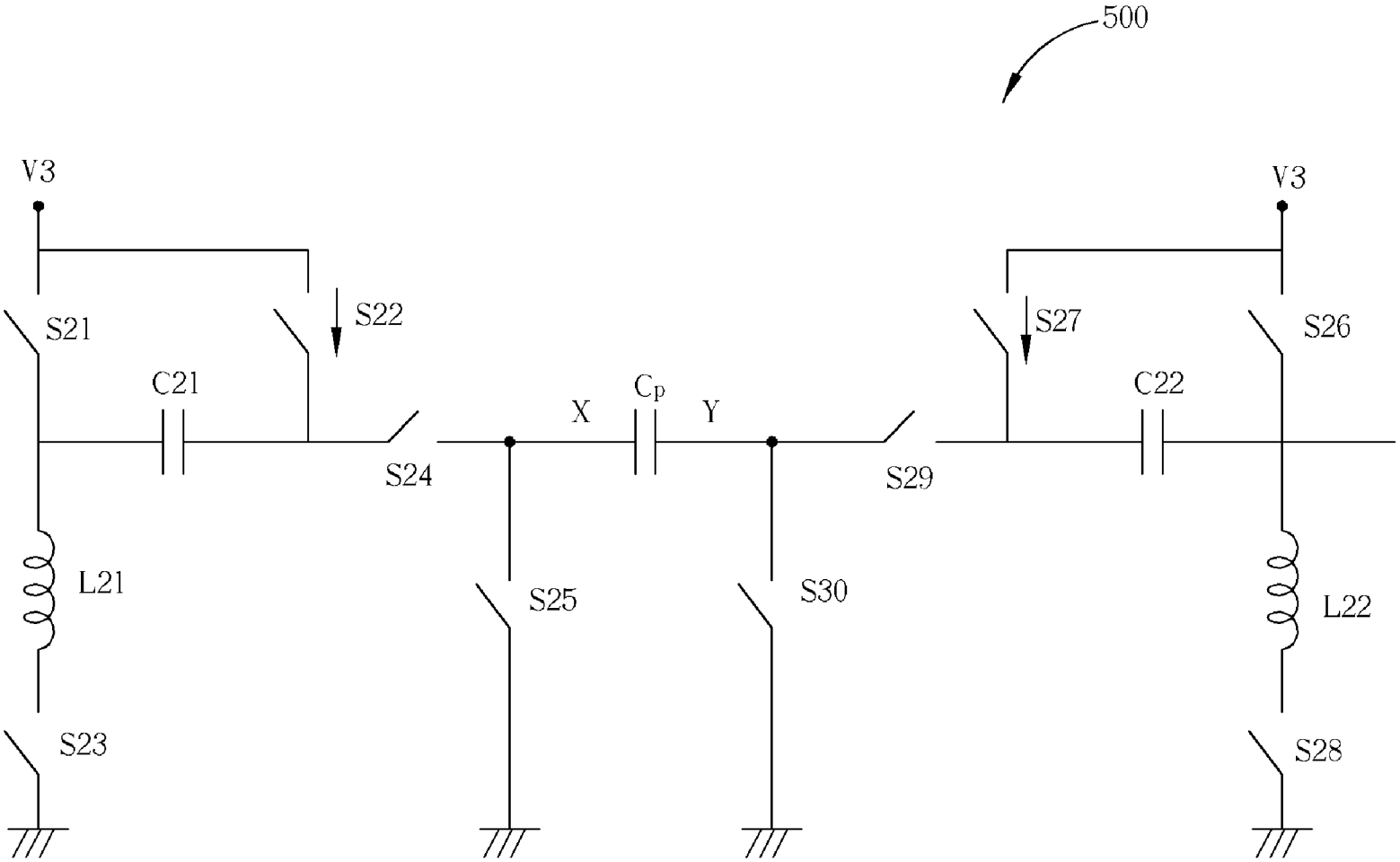
FIG. 5 is shows a circuit diagram of a plasma display panel driving circuit according to a second embodiment of the present invention.

Please refer to FIG. 5. FIG. 5 is shows a circuit diagram of a plasma display panel driving circuit 500 according to a second embodiment of the present invention. The driving circuit 500 is a special case of the driving circuit 400 shown in FIG. 4 in which the voltage sources V21 and V24 are the same positive voltage sources, and are labeled as V3 in FIG. 5. In addition, voltage sources V22, V23, V25, and V26 are all ground. All other components of the driving circuit 500 are the same as the driving circuit 400.

Figure 6:
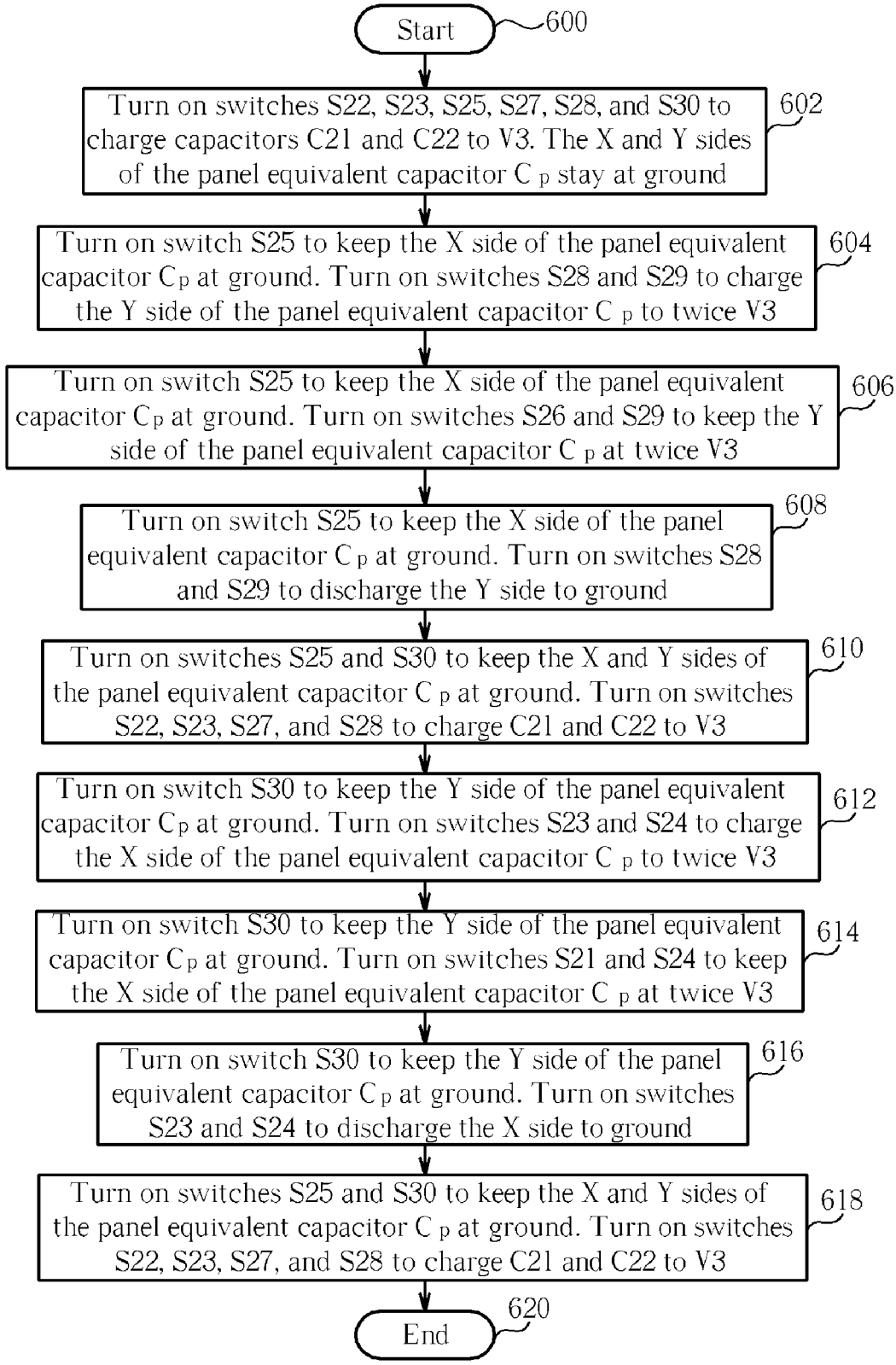
FIG. 6 is a flowchart illustrating the operation of the driving circuit of the second embodiment for creating a sustain waveform.

Please refer to FIG. 6, which illustrates the operation of the driving circuit 500 of the second embodiment for creating a sustain waveform. Steps contained in the flowchart will be explained as follows.

Step 600: Start.

Step 602: The switches S22, S23, S25, S27, S28, and S30 are turned on. The capacitors C21 and C22 are charged to the voltage potential of V3. The positive terminal of C21 is at the node of the connection of S22 and S24. The positive terminal of C22 is at the node of the connection of S27 and S29. The X side and Y side of the panel equivalent capacitor Cp keep at ground.

Step 604: Keep the voltage potential at the X side of the panel equivalent capacitor Cp at ground by turning on the switch S25. Charge the Y side of the panel equivalent capacitor Cp by turning on the switches S28 and S29. The voltage potential at Y side of the panel equivalent capacitor Cp goes up to twice the voltage potential of V3 through the components S28, S29, L22, and C22.

Step 606: Keep the voltage potential at the X side of the panel equivalent capacitor Cp at ground by turning on the switch S25. Keep the voltage potential at the Y side of the panel equivalent capacitor Cp at twice the voltage potential of V3 by turning on the switches S26 and S29.

Step 608: Keep the voltage potential at the X side of the panel equivalent capacitor Cp at ground by turning on the switch S25. Discharge the Y side of the panel equivalent capacitor Cp by turning on the switches S28 and S29. The voltage potential at Y side of the panel equivalent capacitor Cp goes down to ground through the components S28, S29, L22, and C22.

Step 610: Keep the voltage potential at the X side of the panel equivalent capacitor Cp at ground by turning on the switch S25. Keep the voltage potential at the Y side of the panel equivalent capacitor Cp at ground by turning on the switch S30. In the meantime, the switches S22 and S23 are turned on for charging C21 by V3. The switches S27 and S28 are turned on for charging C22 by V3.

Step 612: Keep the voltage potential at the Y side of the panel equivalent capacitor Cp at ground by turning on the switch S30. Charge the X side of the panel equivalent capacitor Cp by turning on the switches S23 and S24. The voltage potential at X side of the panel equivalent capacitor Cp goes up to twice the voltage potential of V3 through the components S23, S24, L21, and C21.

Step 614: Keep the voltage potential at the Y side of the panel equivalent capacitor Cp at ground by turning on the switch S30. Keep the voltage potential at the X side of the panel equivalent capacitor Cp at twice the voltage potential of V3 by turning on the switches S21 and S24.

Step 616: Keep the voltage potential at the Y side of the panel equivalent capacitor Cp at ground by turning on the switch S30. Discharge the X side of the panel equivalent capacitor Cp by turning on the switches S23 and S24. The voltage potential at X side of the panel equivalent capacitor Cp goes down to ground through the components S23, S24, L21, and C21.

Step 618: Keep the voltage potential at the Y side of the panel equivalent capacitor Cp at ground by turning on the switch S30. Keep the voltage potential at the X side of the panel equivalent capacitor Cp at ground by turning on the switch S25. In the meantime, the switches S22 and S23 are turned on for charging C21 by V3. The switches S27 and S28 are turned on for charging C22 by V3.

Step 620: End.

It is also allowed to keep the voltage potentials at the X and/or Y sides of the panel equivalent capacitor Cp at twice the voltage potential of V3 when the other side of the panel equivalent capacitor Cp is charged or discharged. In addition, it is also allowed to charge and discharge the X side of the panel equivalent capacitor Cp during the periods of discharging and charging the Y side of the panel equivalent capacitor Cp, respectively.

Figure 7:
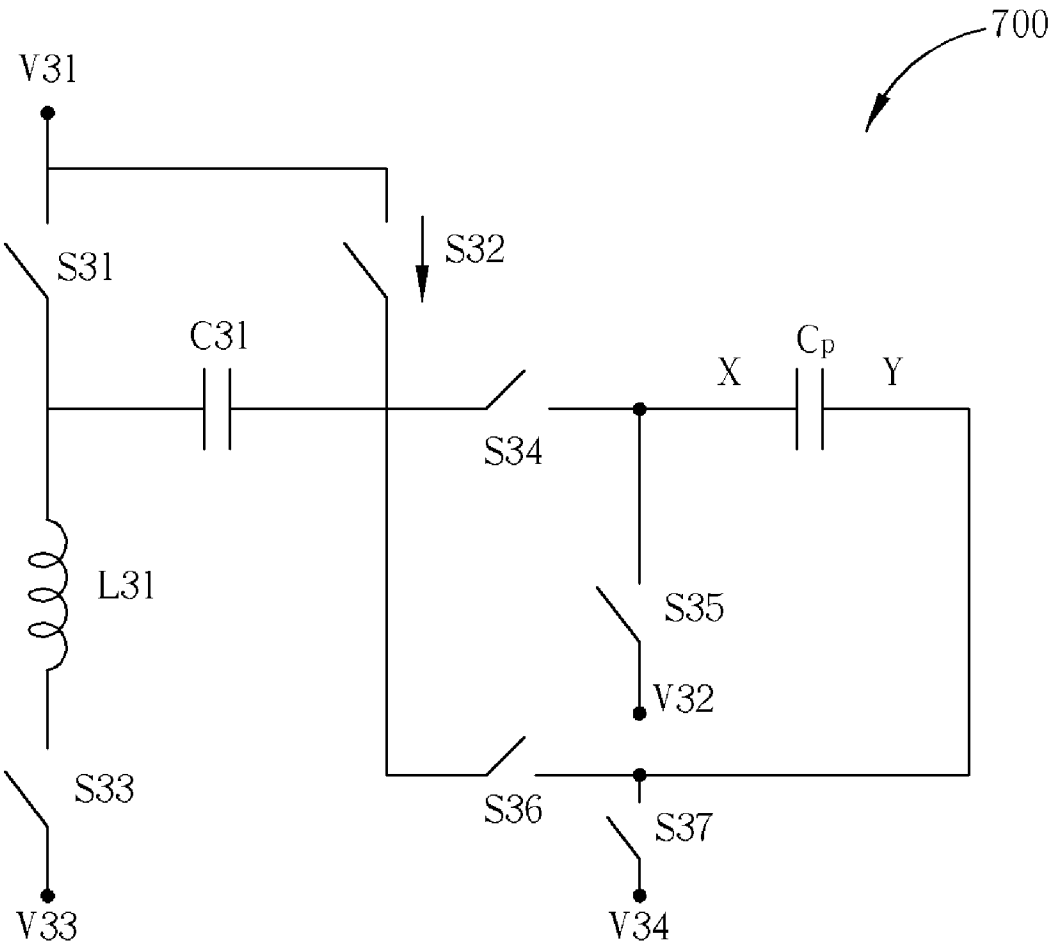
FIG. 7 shows a circuit diagram of a plasma display panel driving circuit according to a third embodiment of the present invention.

Please refer to FIG. 7. FIG. 7 shows a circuit diagram of a plasma display panel driving circuit 700 according to a third embodiment of the present invention. The driving circuit 700 comprises switches S31 to S37, a capacitor C31, an inductor L31, and voltage sources V31 to V34. Switch S32 is a unidirectional switch, and the current direction of switch S32 is away from the voltage source V31, as indicated by the arrow in FIG. 7. The driving circuit 700 has an panel equivalent capacitor Cp of the PDP, which has an X side and a Y side. The voltage potential output by voltage source V31 is greater than that of the voltage sources V32, V33, and V34. The voltage potentials output by the voltage sources V32, V33, and V34 can be the same or can be different. Inductor L31 and switch S33 are electrically connected in series.

Figure 8:
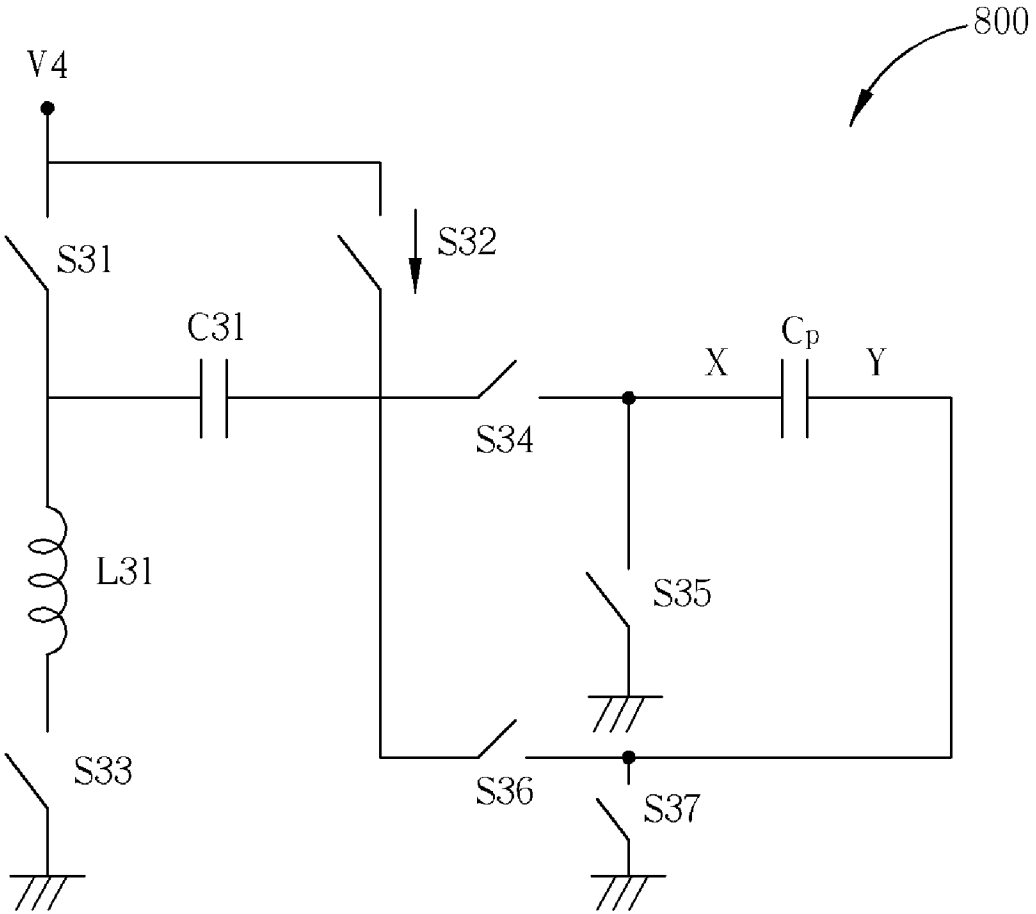
FIG. 8 is shows a circuit diagram of a plasma display panel driving circuit according to a fourth embodiment of the present invention.

Please refer to FIG. 8. FIG. 8 is shows a circuit diagram of a plasma display panel driving circuit 800 according to a fourth embodiment of the present invention. The driving circuit 800 is a special case of the driving circuit 700 shown in FIG. 7 in which the voltage source V31 is a positive voltage source V4, and the voltage sources V32, V33, and V34 are all ground. All other components of the driving circuit 800 are the same as the driving circuit 700.

Figure 9:
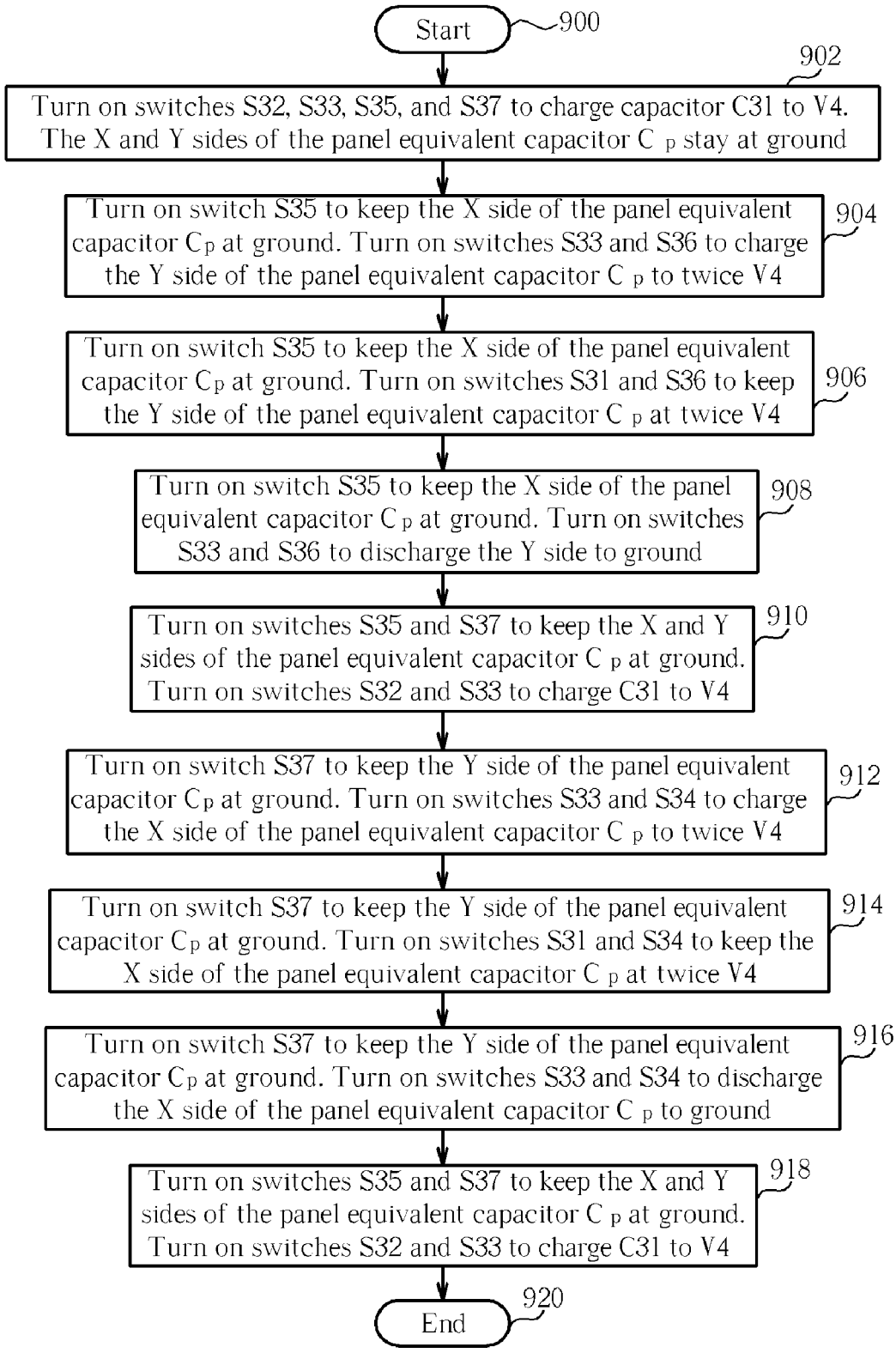
FIG. 9 is a flowchart illustrating the operation of the driving circuit of the fourth embodiment for creating a sustain waveform.

Please refer to FIG. 9, which illustrates the operation of the driving circuit 800 of the fourth embodiment for creating a sustain waveform. Steps contained in the flowchart will be explained as follows.

Step 900: Start.

Step 902: The switches S32, S33, S35, and S37 are turned on. The capacitor C31 is charged to the voltage potential of V4. The positive terminal of C31 is at the node of the connection of S32, S34, and S36. The X side and Y side of the panel equivalent capacitor Cp keep at ground.

Step 904: Keep the voltage potential at the X side of the panel equivalent capacitor Cp at ground by turning on the switch S35. Charge the Y side of the panel equivalent capacitor Cp by turning on the switches S33 and S36. The voltage potential at Y side of the panel equivalent capacitor Cp goes up to twice the voltage potential of V4 through the components S33, S36, L31, and C31.

Step 906: Keep the voltage potential at the X side of the panel equivalent capacitor Cp at ground by turning on the switch S35. Keep the voltage potential at the Y side of the panel equivalent capacitor Cp at twice the voltage potential of V4 by turning on the switches S31 and S36.

Step 908: Keep the voltage potential at the X side of the panel equivalent capacitor Cp at ground by turning on the switch S35. Discharge the Y side of the panel equivalent capacitor Cp by turning on the switches S33 and S36. The voltage potential at Y side of the panel equivalent capacitor Cp goes down to ground through the components S33, S36, L31, and C31.

Step 910: Keep the voltage potential at the X side of the panel equivalent capacitor Cp at ground by turning on the switch S35. Keep the voltage potential at the Y side of the panel equivalent capacitor Cp at ground by turning on the switch S37. In the meantime, the switches S32 and S33 are turned on for charging C31 by V4.

Step 912: Keep the voltage potential at the Y side of the panel equivalent capacitor Cp at ground by turning on the switch S37. Charge the X side of the panel equivalent capacitor Cp by turning on the switches S33 and S34. The voltage potential at X side of the panel equivalent capacitor Cp goes up to twice the voltage potential of V4 through the components S33, S34, L31, and C31.

Step 914: Keep the voltage potential at the Y side of the panel equivalent capacitor Cp at ground by turning on the switch S37. Keep the voltage potential at the X side of the panel equivalent capacitor Cp at twice the voltage potential of V4 by turning on the switches S31 and S34.

Step 916: Keep the voltage potential at the Y side of the panel equivalent capacitor Cp at ground by turning on the switch S37. Discharge the X side of the panel equivalent capacitor Cp by turning on the switches S33 and S34. The voltage potential at X side of the panel equivalent capacitor Cp goes down to ground through the components S33, S34, L31, and C31.

Step 918: Keep the voltage potential at the Y side of the panel equivalent capacitor Cp at ground by turning on the switch S37. Keep the voltage potential at the X side of the panel equivalent capacitor Cp at ground by turning on the switch S35. In the meantime, the switches S32 and S33 are turned on for charging C31 by V4.

Step 920: End.

In summary, the present invention driving circuits utilize switches to make the sustained voltage twice the voltage potential supplied by the voltage source. The voltage stress of some components will therefore be lower. In addition, the numbers of components can be reduced in the driving circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plasma display panel driving circuit comprising:

a panel equivalent capacitor having a first side and a second side;

a first switch electrically connected between the first side of the panel equivalent capacitor and a first voltage;

a second switch electrically connected between the first side of the panel equivalent capacitor and a first node;

a third switch electrically connected between the first node and a second voltage;

a first capacitor electrically connected between the first node and a second node;

a fourth switch electrically connected between the second node and the second voltage;

a first inductor and a fifth switch electrically connected in series between the second node and a third voltage;

a sixth switch electrically connected between the second side of the panel equivalent capacitor and a fourth voltage;

a seventh switch electrically connected between the second side of the panel equivalent capacitor and a third node;

an eighth switch electrically connected between the third node and a fifth voltage;

a second capacitor electrically connected between the third node and a fourth node;

a ninth switch electrically connected between the fourth node and the fifth voltage; and a second inductor and a tenth switch electrically connected in series between the fourth node and a sixth voltage.

2. The plasma display panel driving circuit of claim 1, wherein the second voltage is greater than the first and third voltages, and the fifth voltage is greater than the fourth and sixth voltages.

3. The plasma display panel driving circuit of claim 2, wherein the second and fifth voltages have the same voltage potential, and the first, third, fourth, and sixth voltages have the same voltage potentials.

4. The plasma display panel driving circuit of claim 3, wherein the second and fifth voltages are supplied by a voltage source and the first, third, fourth, and sixth voltages are ground.

5. The plasma display panel driving circuit of claim 2, wherein the third switch and the eighth switch are unidirectional switches.

6. The plasma display panel driving circuit of claim 5, wherein current only passes through the third switch away from the second voltage, and current only passes through the eighth switch away from the fifth voltage.

7. The plasma display panel driving circuit of claim 1, wherein the first inductor is coupled to the second node and the fifth switch is electrically connected between the first inductor and the third voltage, and the second inductor is coupled to the fourth node and the tenth switch is electrically connected between the second inductor and the sixth voltage.

8. The plasma display panel driving circuit of claim 1, wherein the first through tenth switches are transistors.

9. The plasma display panel driving circuit of claim 8, wherein the transistors are P-type or N-type metal oxide semiconductor (MOS) transistors or insulated gate bipolar transistors (IGBT) or bipolar junction transistors (BJT).

10. A plasma display panel driving circuit comprising:

a panel equivalent capacitor having a first side and a second side;

a first switch electrically connected between the first side of the panel equivalent capacitor and a first voltage;

a second switch electrically connected between the second side of the panel equivalent capacitor and a second voltage;

a third switch electrically connected between the second side of the panel equivalent capacitor and a first node;

a fourth switch electrically connected between the first side of the panel equivalent capacitor and the first node;

a fifth switch electrically connected between the first node and a third voltage;

a sixth switch electrically connected between the third voltage and a second node;

a capacitor electrically connected between the first node and the second node; and an inductor and a seventh switch electrically connected in series between the second node and a fourth voltage.

11. The plasma display panel driving circuit of claim 10, wherein the third voltage is greater than the first, second, and fourth voltages.

12. The plasma display panel driving circuit of claim 11, wherein the first, second, and fourth voltages have the same voltage potentials.

13. The plasma display panel driving circuit of claim 12, wherein the third voltage is supplied by a voltage source and the first, second, and fourth voltages are ground.

14. The plasma display panel driving circuit of claim 11, wherein the fifth switch is a unidirectional switch.

15. The plasma display panel driving circuit of claim 14, wherein current only passes through the fifth switch away from the third voltage.

16. The plasma display panel driving circuit of claim 10, wherein the inductor is coupled to the second node and the seventh switch is electrically connected between the inductor and the fourth voltage.

17. The plasma display panel driving circuit of claim 10, wherein the first through seventh switches are transistors.

18. The plasma display panel driving circuit of claim 17, wherein the transistors are P-type or N-type metal oxide semiconductor (MOS) transistors or insulated gate bipolar transistors (IGBT) or bipolar junction transistors (BJT).

* * * * *